US011025000B2

(12) United States Patent
Wan et al.

(10) Patent No.: US 11,025,000 B2
(45) Date of Patent: Jun. 1, 2021

(54) TERMINAL RETAINER, CONNECTOR HOUSING, CONNECTOR AND CONNECTOR ASSEMBLY

(71) Applicant: Tyco Electronics (Shanghai) Co. Ltd., Shanghai (CN)

(72) Inventors: Feng Wan, Shanghai (CN); Haomai Yin, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 16/691,825

(22) Filed: Nov. 22, 2019

(65) Prior Publication Data

US 2020/0176914 A1 Jun. 4, 2020

(30) Foreign Application Priority Data

Nov. 30, 2018 (CN) ..... 201822009319.7

(51) Int. Cl.

| | |
|---|---|
| ***H01R 13/42*** | (2006.01) |
| ***H01R 13/426*** | (2006.01) |
| ***H01R 13/627*** | (2006.01) |
| ***H01R 13/506*** | (2006.01) |

(52) U.S. Cl.
CPC ..... *H01R 13/426* (2013.01); *H01R 13/506* (2013.01); *H01R 13/6272* (2013.01)

(58) Field of Classification Search
CPC . H01R 13/426; H01R 13/506; H01R 13/6272
USPC ..... 439/656
See application file for complete search history.

(56) References Cited

U.S. PATENT DOCUMENTS

| | | | | |
|---|---|---|---|---|
| 7,033,201 | B2 * | 4/2006 | Ichida | H01R 13/6272 439/352 |
| 7,201,615 | B2 * | 4/2007 | Kojima | H01R 13/4223 439/752 |
| 7,252,530 | B2 * | 8/2007 | Shamoto | H01R 13/641 439/352 |
| 7,993,170 | B2 * | 8/2011 | Nakata | H01R 13/4223 439/877 |
| 8,226,436 | B2 * | 7/2012 | Suzuki | H01R 13/4364 439/595 |

(Continued)

*Primary Examiner* — Alexander Gilman
(74) *Attorney, Agent, or Firm* — Saxton & Stump, LLC

(57) ABSTRACT

The present application relates to a terminal retainer, a connector housing, connector, and connector assembly. The terminal retainer has a tubular retaining part and the tubular retaining part comprises a tube wall and a cavity enclosed by the tube wall; the tubular retaining part axially extends a specified length; the tube wall is provided with a locking mechanism and the locking mechanism comprises an initial locking mechanism and a final locking mechanism which are respectively fitted with a mating mechanism to lock the terminal retainer in an initial locking position and a final locking position, respectively; the tube wall is further provided with an abutment mechanism, and the abutment mechanism is configured to abut against a snap-fit mechanism located in the cavity when the terminal retainer is in the final locking position so that the snap-fit mechanism can be retained in a snap-fit position. The terminal retainer may be preassembled with a connector housing to avoid scattering and loss of parts and to be ready for use.

20 Claims, 12 Drawing Sheets

(56) References Cited

U.S. PATENT DOCUMENTS

| | | | | |
|---|---|---|---|---|
| 8,678,866 | B2 * | 3/2014 | Hiraishi | H01R 13/4365 439/752 |
| 9,407,025 | B2 * | 8/2016 | Hashimoto | H01R 13/432 |
| 9,509,076 | B2 * | 11/2016 | Hashimoto | H01R 13/4223 |
| 9,543,687 | B2 * | 1/2017 | Horiuchi | H01R 13/502 |
| 9,666,989 | B2 * | 5/2017 | Horiuchi | H01R 13/641 |
| 9,742,108 | B2 * | 8/2017 | Matsuura | H01R 13/113 |
| 9,748,690 | B2 * | 8/2017 | Sasaki | H01R 13/4223 |
| 10,211,566 | B2 * | 2/2019 | Nagayama | H01R 13/5825 |
| 10,418,756 | B2 * | 9/2019 | Fennen | H01R 13/6633 |
| 10,476,194 | B2 * | 11/2019 | Hashimoto | H01R 13/055 |
| 10,476,207 | B2 * | 11/2019 | Guillanton | H01R 13/631 |
| 10,707,620 | B2 * | 7/2020 | Imai | H01R 13/5202 |

* cited by examiner

TERMINAL RETAINER, CONNECTOR HOUSING, CONNECTOR AND CONNECTOR ASSEMBLY

TECHNICAL FIELD

The present application relates to a terminal retainer, a connector housing, a connector, and a connector assembly.

BACKGROUND ART

A large number of connectors are used in automobile circuits and communication transmission. Connector assemblies are typically mated by male and female connectors each composed of a connector housing and a connection terminal mounted within the connector housing. The connection terminal needs to be stably mounted in the connector housing to ensure the use effect. In the existing connector, a plurality of components are used to stably mount and fix the connection terminal, and the components are large in number and cannot be pre-assembled, which causes the components scattering, easy loss and inconvenient to assemble.

SUMMARY OF INVENTION

One of the objectives of the application is to provide a terminal retainer, a connector and a connector assembly which are convenient to use to overcome the defects in the prior art.

According to a first aspect of the application, there is provided a terminal retainer comprising a tubular retaining portion, wherein the tubular retaining portion comprises a tube wall and a tube cavity enclosed by the tube wall, and extends a specified length in an axial direction. The tube wall is provided with a locking structure comprising an initial locking structure and a final locking structure which are mated with a mating structure respectively to lock the terminal retainer in an initial locking position and a final locking position, respectively. The tube wall is also provided with an abutting structure which is configured to abut against a snap-fit mechanism located in the tube cavity when the terminal retainer is in the final locking position, so that the snap-fit mechanism is retained in a snap-fit position.

According to one embodiment of the application, the initial locking structure and the final locking structure are disposed on the same surface of the tube wall.

According to one embodiment of the application, the locking structure and the abutting structure are disposed on two sections of the tube wall radially opposite to each other, respectively.

According to one embodiment of the application, the locking structure is a through-hole, a counterbore or a groove.

According to one embodiment of the application, the abutting structure is disposed to extend from an inner surface of the tube wall and project into the tube cavity.

According to one embodiment of the application, the abutting structure is a U-shaped groove, an opening of which is disposed to face away from the tube cavity.

According to one embodiment of the application, an outer surface of the tube wall is provided with a convex rib configured to protrude from the outer surface of the tube wall.

According to one embodiment of the application, the convex rib and the locking structure are provided on different surfaces of the tube wall, respectively.

According to one embodiment of the application, the terminal retainer is also provided with a flange plate perpendicular to the axial direction protruding from the tube wall.

According to one embodiment of the application, the tube wall is provided with a mating groove extending continuously in the axial direction through the terminal retainer.

According to one embodiment of the application, the terminal retainer is also provided with a mating bar projecting axially from the tube wall.

According to a second aspect of the application, there is provided a connector housing, wherein an end of the connector housing is provided with a terminal mounting tube and an elastic arm, and an outer surface of the terminal mounting tube is provided with a bump which is configured to be mated with a locking structure on a terminal retainer, so that the terminal retainer is held on the connector housing.

According to one embodiment of the application, an end of the connector housing is provided with a receiving cavity configured for receiving the terminal retainer, and the terminal mounting tube and the elastic arm are arranged in the receiving cavity.

According to one embodiment of the present application, an inner surface of the connector housing is protrudingly provided with a convex ridge configured to be contactable with an outer surface of the terminal retainer.

According to a third aspect of the application, there is provided a connector comprising a connector housing and the above-mentioned terminal retainer.

According to one embodiment of the application, the connector housing is provided with a receiving cavity in which a terminal mounting tube and an elastic arm are provided, and the terminal mounting tube is provided with a perforation. A connection terminal is provided with a flange, and an end of the connection terminal is inserted into the terminal mounting tube. The terminal retainer is inserted into the receiving cavity and abuts against the elastic arm, so that the elastic arm is held in a state of abutting the flange to allow the elastic arm to prevent the connection terminal from exiting.

According to one embodiment of the application, the terminal retainer has an initial locking position and a final locking position within the receiving cavity. In the final locking position, the terminal retainer is inserted into the receiving cavity to abut against the elastic arm, so that the elastic arm is kept in a state of abutting against the flange through the perforation, or the flange protrudes from the perforation, and the retainer abuts against the elastic arm to keep the elastic arm in a state of abutting against the flange.

According to one embodiment of the application, the connection terminal is a square terminal.

According to one embodiment of the application, an end of the housing is provided with a terminal mounting tube and an elastic arm, and a bump is provided on an outer surface of the terminal mounting tube and configured to be mated with a locking structure on the terminal retainer to hold the terminal retainer on the housing.

According to one embodiment of the application, an end of the housing is provided with a receiving cavity configured for receiving the terminal retainer; the terminal mounting tube and the elastic arm are arranged in the receiving cavity.

According to one embodiment of the present application, an inner surface of the housing is protrudingly provided with a convex ridge configured to be contactable with an outer surface of the terminal retainer.

According to one embodiment of the application, the convex ridge is disposed toward the bump.

According to one embodiment of the application, the connector further comprises a connection terminal, and the connection terminal is a stamped part.

According to a fourth aspect of the application, there is provided a connector assembly comprising a connector and a mating connector, wherein the connector includes a first connector housing and a first terminal retainer disposed on the first connector housing; the mating connector comprises a second connector housing and a second terminal retainer disposed on the second connector housing; the connector is pluggably in plug-in connection with the mating connector; and the first terminal retainer and the second terminal retainer are respectively the terminal retainer mentioned above, wherein a tubular retaining portion of one of the terminal retainers is provided with a mating groove extending along the axial direction, and the other terminal retainer is provided with a mating bar; the mating bar has a shape mated with that of the mating groove and is configured to be pluggably inserted into the mating groove; and after the first connector housing is plugged into the second connector housing, the mating bar is arranged to be inserted in the mating groove.

According to one embodiment of the application, the first connector housing is provided with a first receiving cavity within which a male terminal mounting tube and a first elastic arm are provided, and the male terminal mounting tube is provided with a first perforation and a male terminal is inserted into the male terminal mounting tube. The first terminal retainer is inserted into the first receiving cavity so as to be abuttable against the first elastic arm, so that the first elastic arm is kept in a state of abutting against the male terminal to prevent the male terminal from exiting. The second connector housing is provided with a second receiving cavity within which a female terminal mounting tube and a second elastic arm are provided, and the female terminal mounting tube is provided with a second perforation and a female terminal is inserted into the female terminal mounting tube. The second terminal retainer is inserted into the second receiving cavity so as to be abuttable against the second elastic arm, so that the second elastic arm is kept in a state of abutting against the female terminal to prevent the female terminal from exiting.

According to one embodiment of the application, an outer surface of the male terminal mounting tube is provided with a first bump, an initial locking structure of the first terminal retainer is a first through-hole, a first counterbore or a first groove, and a final locking structure of the first terminal retainer is a second through-hole, a second counterbore or a second groove; the first bump is arranged on a moving route of the initial locking structure and the final locking structure of the first terminal retainer; when the first bump is embedded into the first through-hole, the first counterbore or the first groove, the first terminal retainer is kept in an initial locking position; and when the second bump is embedded into the second through-hole, the second counterbore or the second groove, the first terminal retainer is kept in a final locking position.

According to one embodiment of the application, an outer surface of the female terminal mounting tube is provided with a second bump, an initial locking structure of the second terminal retainer is a third through-hole, a third counterbore or a third groove, and a final locking structure of the second terminal retainer is a fourth through-hole, a fourth counterbore or a fourth groove; the second bump is arranged on a moving route of the initial locking structure and the final locking structure of the second terminal retainer; when the second bump is embedded into the third through-hole, the third counterbore or the third groove, the second terminal retainer is kept in an initial locking position; and when the second bump is embedded into the fourth through-hole, the fourth counterbore or the fourth groove, the second terminal retainer is kept in a final locking position.

According to one embodiment of the application, the male terminal is provided with a first flange, and the first elastic arm is arranged to abut against the first flange to prevent the male terminal from exiting; and/or the female terminal is provided with a second flange, and the second elastic arm is arranged to abut against the second flange to prevent the female terminal from exiting.

According to one embodiment of the application, an outer surface of the first terminal retainer is in multiple line contact with an inner surface of the first connector housing; and/or an outer surface of the second terminal retainer is in multiple line contact with an inner surface of the second connector housing.

According to one embodiment of the application, an outer surface of the tubular retaining portion is provided with a convex rib; when the first terminal retainer is inserted into the first connector housing, the convex rib is in contact with an inner surface of the first connector housing, and/or when the second terminal retainer is inserted into the second connector housing, the convex rib is in contact with an inner surface of the second connector housing.

According to one embodiment of the application, an inner surface of the first connector housing or the second connector housing is provided with a convex ridge, and the convex ridge is in contact with an outer surface of the tubular retaining portion.

According to one embodiment of the application, the convex ridge is arranged on an inner surface opposite to the positions of the initial locking structure and the final locking structure.

For the terminal retainer, the connector housing, the connector and the connector assembly provided by the application, before the connection terminal is mounted, the terminal retainer can be pre-assembled with the connector housing and held in the initial locking position; after the connection terminal is mounted in position, the terminal retainer can be mounted to the final locking position to firmly mount the connection terminal within the connector housing. The terminal retainer can be pre-assembled with the connector housing, which can prevent parts from scattering and losing. Therefore, the application can avoid the risk of losing parts in case that the connector housing and the connection terminal are not produced in the same place. The terminal retainer can be moved from the initial locking position to the final locking position simply by pushing it, and is convenient to assemble. The connection terminal adopts a square terminal and is convenient to produce, easy to assemble and low in production cost. The arrangement of the convex rib enables the terminal retainer to be in line contact with the connector housing, so that the problems of high manufacturing precision requirement and difficult assembly associated with surface contact can be avoided with low manufacturing precision requirement and easier assembly.

DETAILED DESCRIPTION OF THE INVENTION

Figure 1:
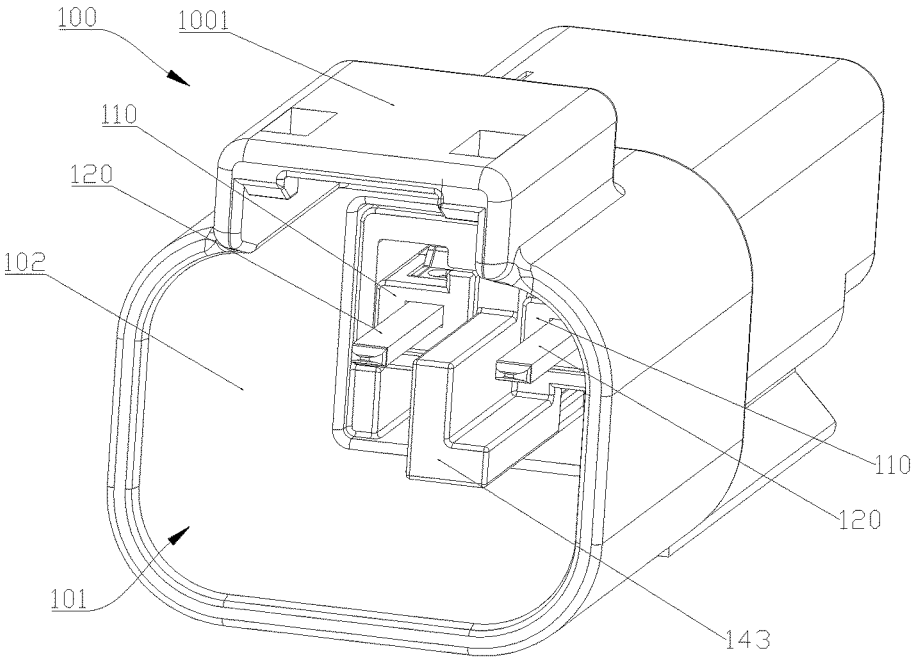
FIG. 1 is a structural schematic view of a connector in Embodiment 1 of the present application.
Figure 2:
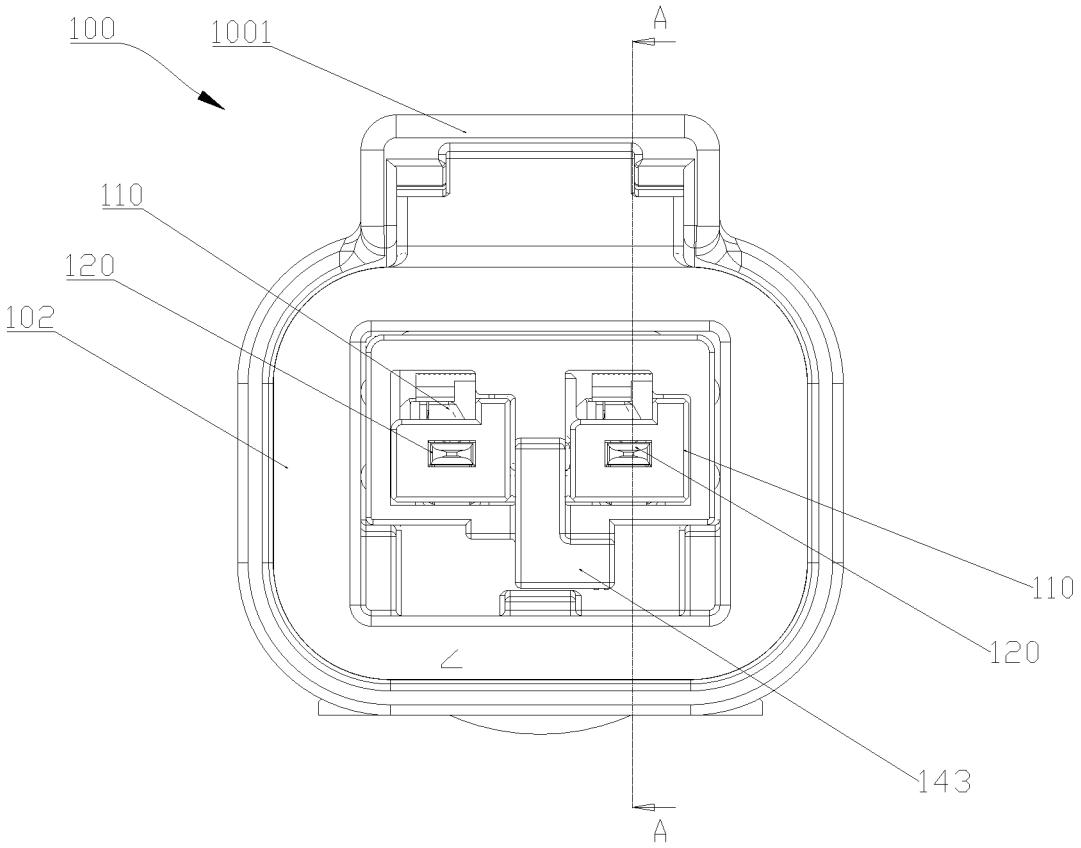
FIG. 2 is a front view of the connector of Embodiment 1.
Figure 3:
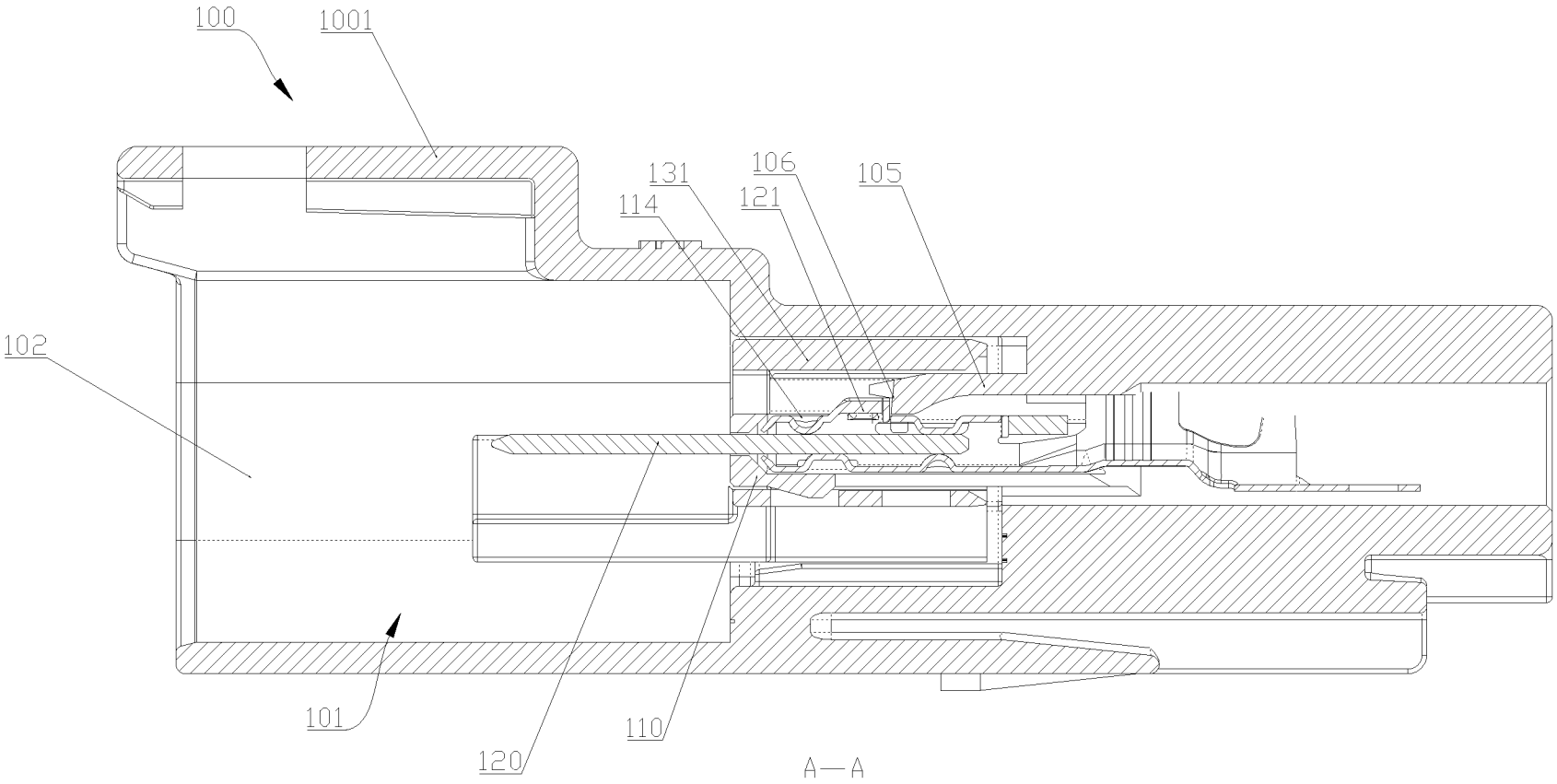
FIG. 3 is a sectional view taken along A-A of FIG. 2.
Figure 4:
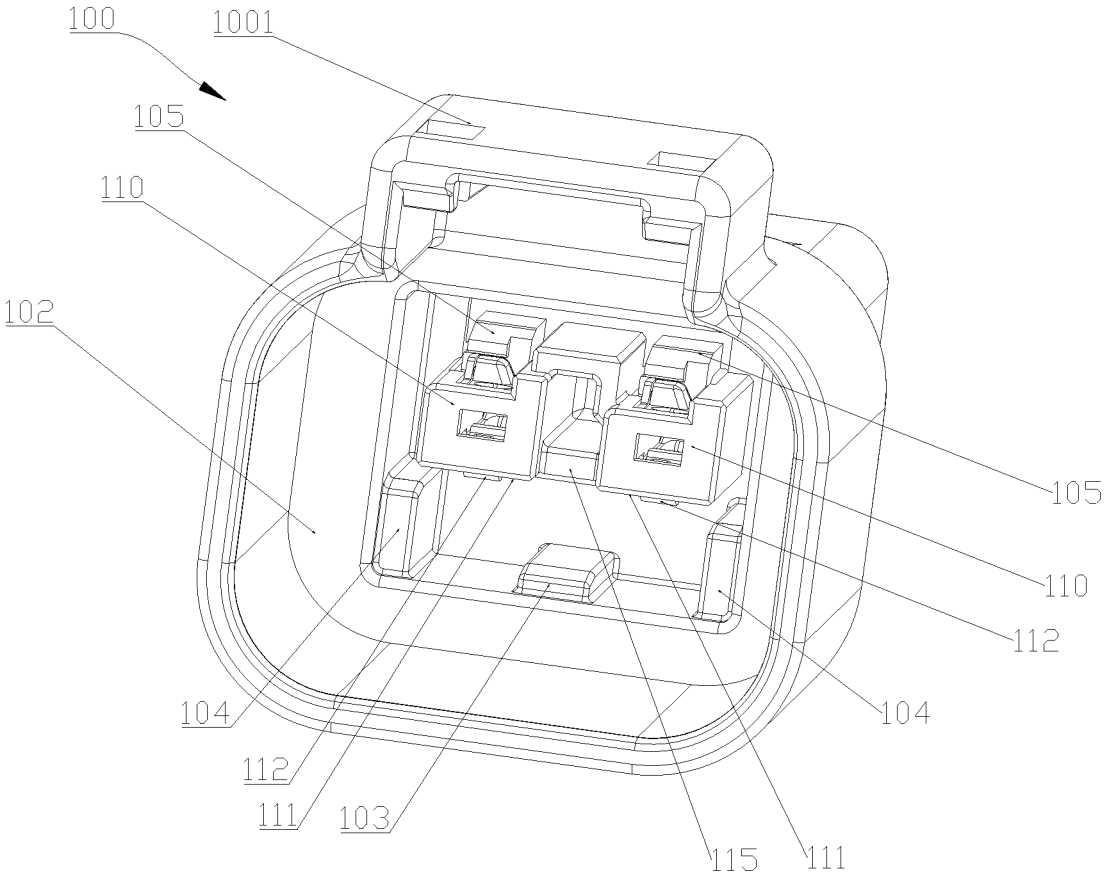
FIG. 4 is a structural schematic view of the first connector housing in Embodiment 1.
Figure 5:
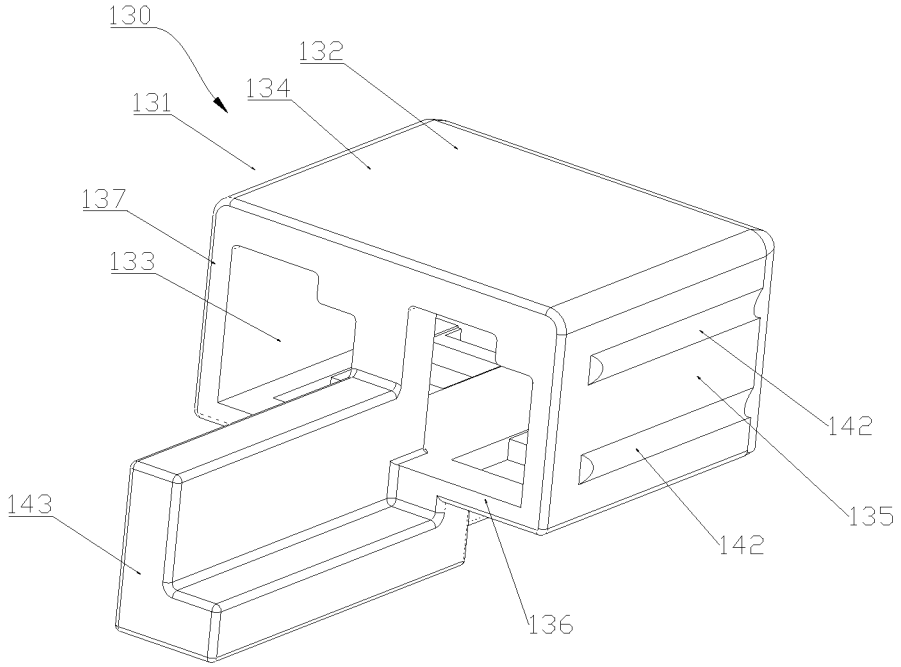
FIG. 5 is a structural schematic view of the first retainer in Embodiment 1.
Figure 6:
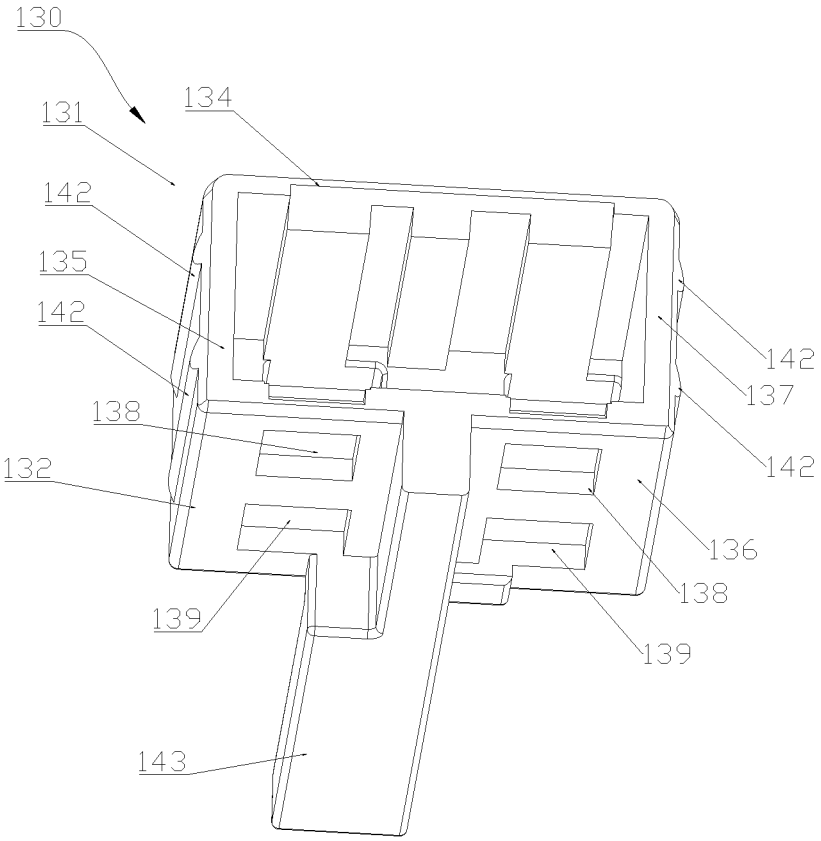
FIG. 6 is a structural schematic view of the first retainer viewed from another angle.

The present application is described in detail below with reference to the accompanying drawings:

Embodiment 1

As shown in FIGS. 1 to 7, a connector 100 includes a first connector housing 1001 and a male terminal 120. The first connector housing 1001 is configured for mounting the male terminal 120. An end of the first connector housing 1001 is provided with a first receiving cavity 101, and the first receiving cavity 101 axially extends to a certain depth. The first receiving cavity 101 is one of the examples of the receiving cavity. In the illustrated example, the first receiving cavity 101 is square in cross-section. The first receiving cavity 1001 is one of the examples of the receiving cavity. An inner surface 102 of the first receiving cavity 101 is provided with a convex ridge 103. The convex ridge 103 protrudes from the inner surface 102 of the first receiving cavity 101. The convex ridge 103 is provided in the middle of the left-right direction as shown. Two baffles 104 are disposed within the first receiving cavity 101. The two baffles 104 are provided on either side of the convex ridge 103, respectively. The two baffles 104 are configured to guide a first terminal retainer 130 described later during plug-in connection. A first elastic arm 105 is disposed within the first receiving cavity 101. An end of the first elastic arm 105 is connected to the connector housing 100 and the other end 106 is disposed to be suspended. The first elastic arm 105 is resiliently arranged and the other end 106 thereof is arranged to be movable under pressure.

A male terminal mounting tube 110 is disposed within the first receiving cavity 101. The male terminal mounting tube 110 is one of the examples of a terminal mounting tube. An end of the male terminal mounting tube 110 is connected to the interior of the connector housing 100 and is disposed to be suspended for a certain length. A lower surface 111 of each male terminal mounting tube 110 is provided with a first bump 112. The first bump 112 protrudes from the lower surface 111. The male terminal mounting tube 110 is provided with a first perforation 114. The two male terminal mounting tubes 110 are connected by a connecting plate 115. The first elastic arm 105 is disposed below the first perforation 114. The first elastic arm 105 is one embodiment of a snap-fit mechanism or the elastic arm as described in the present application.

Figure 7:
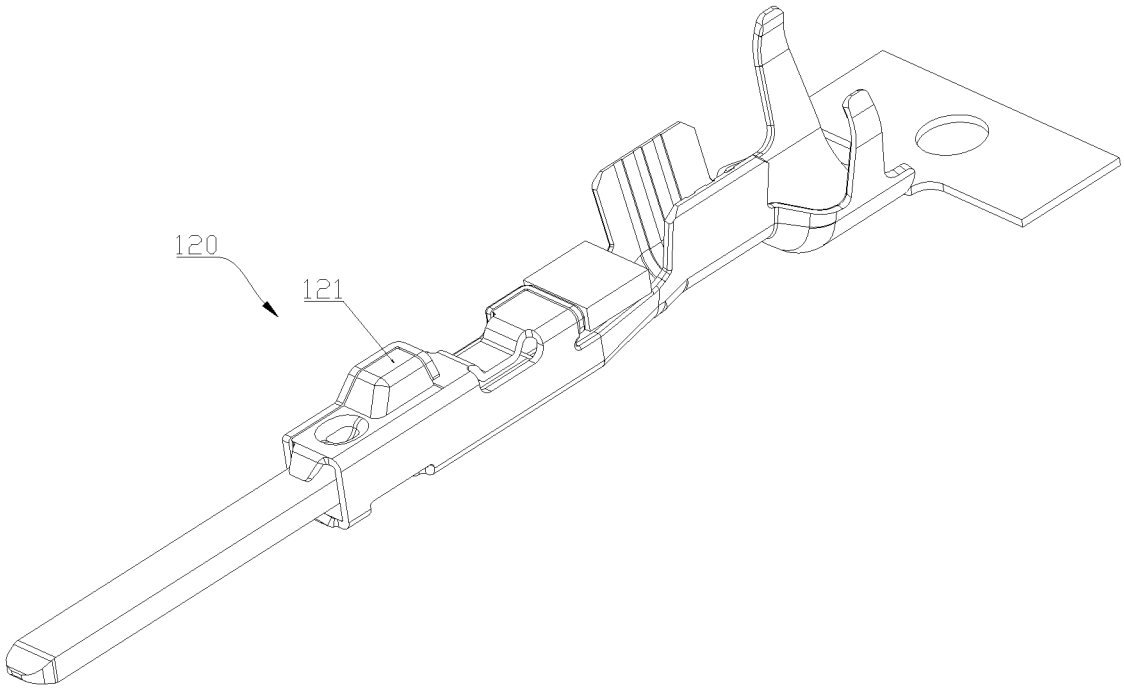
FIG. 7 is a structural schematic view of the male terminal in Embodiment 1.
Figure 8:
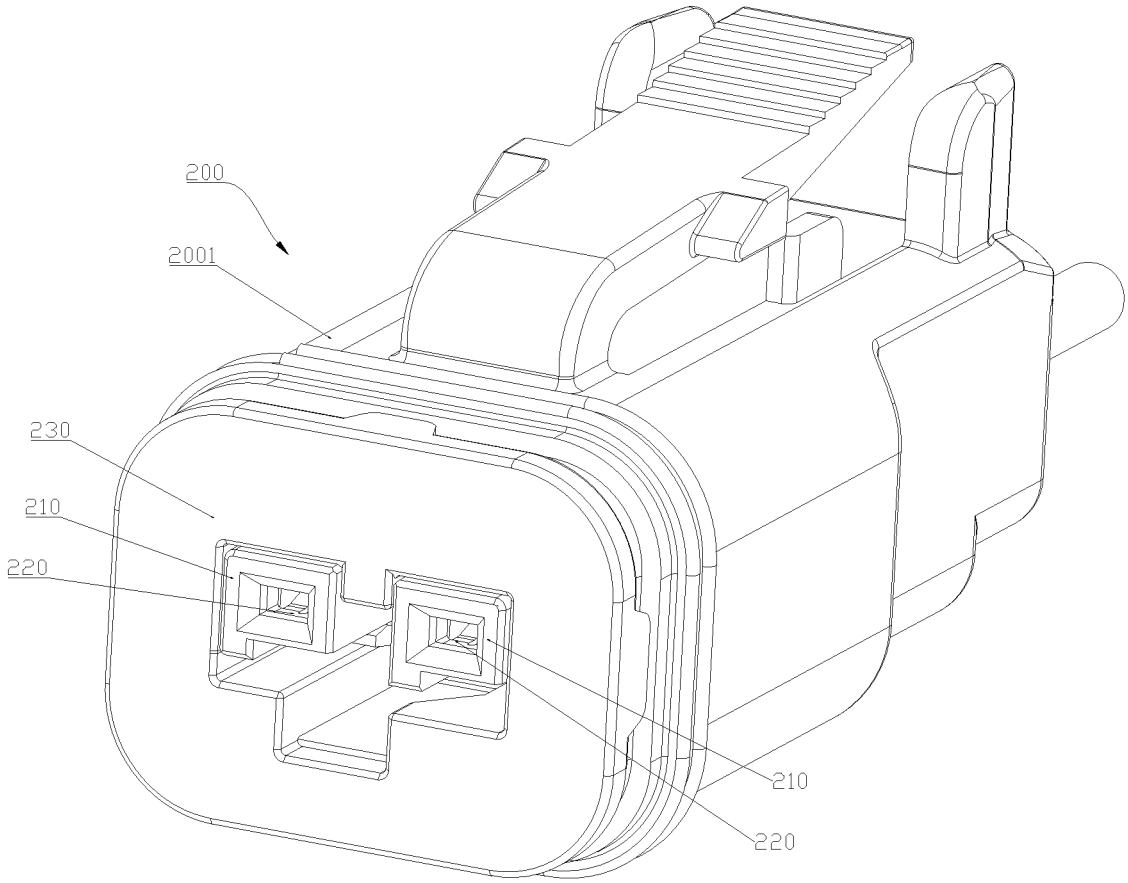
FIG. 8 is a structural schematic view of the connector in Embodiment 2 of the present application.
Figure 9:
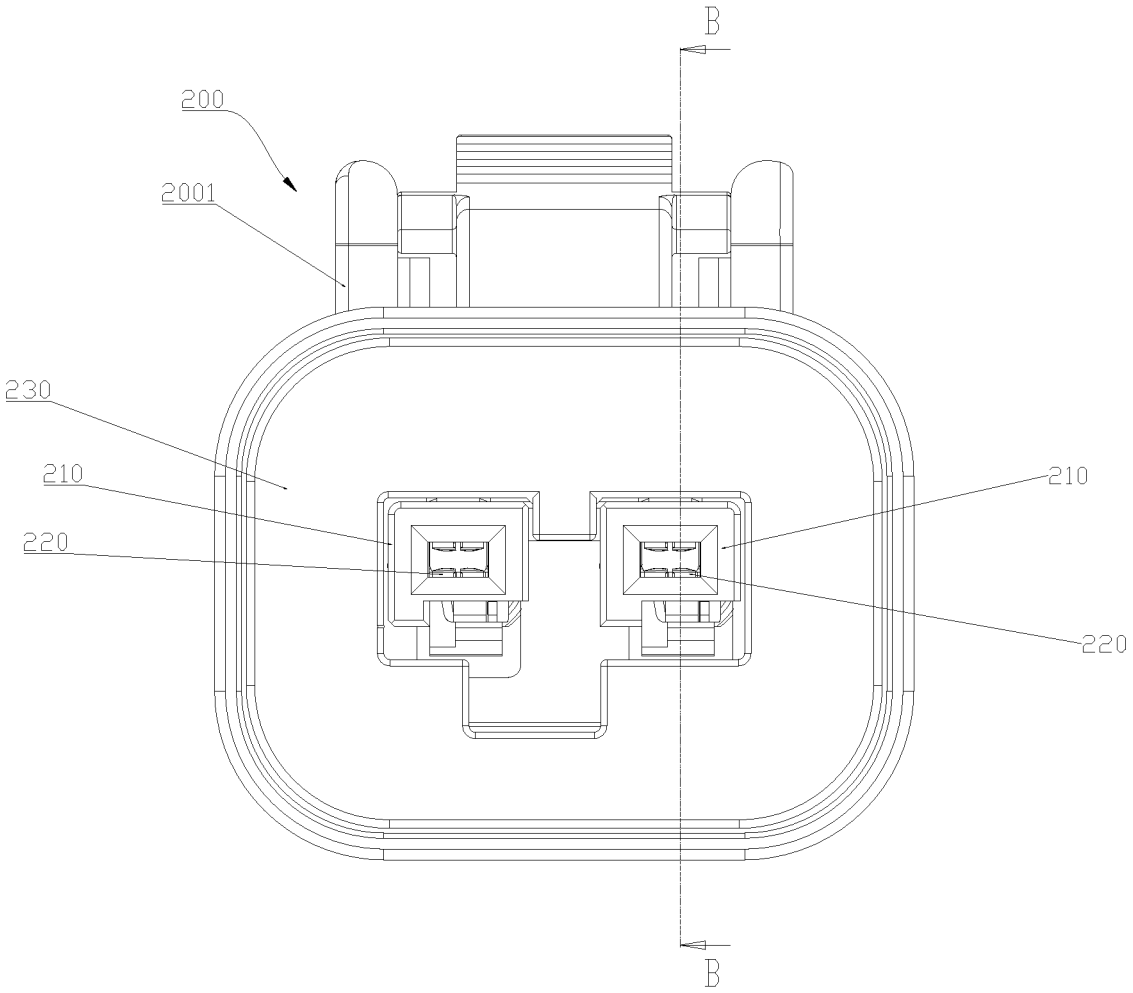
FIG. 9 is a front view of the connector of Embodiment 2.
Figure 10:
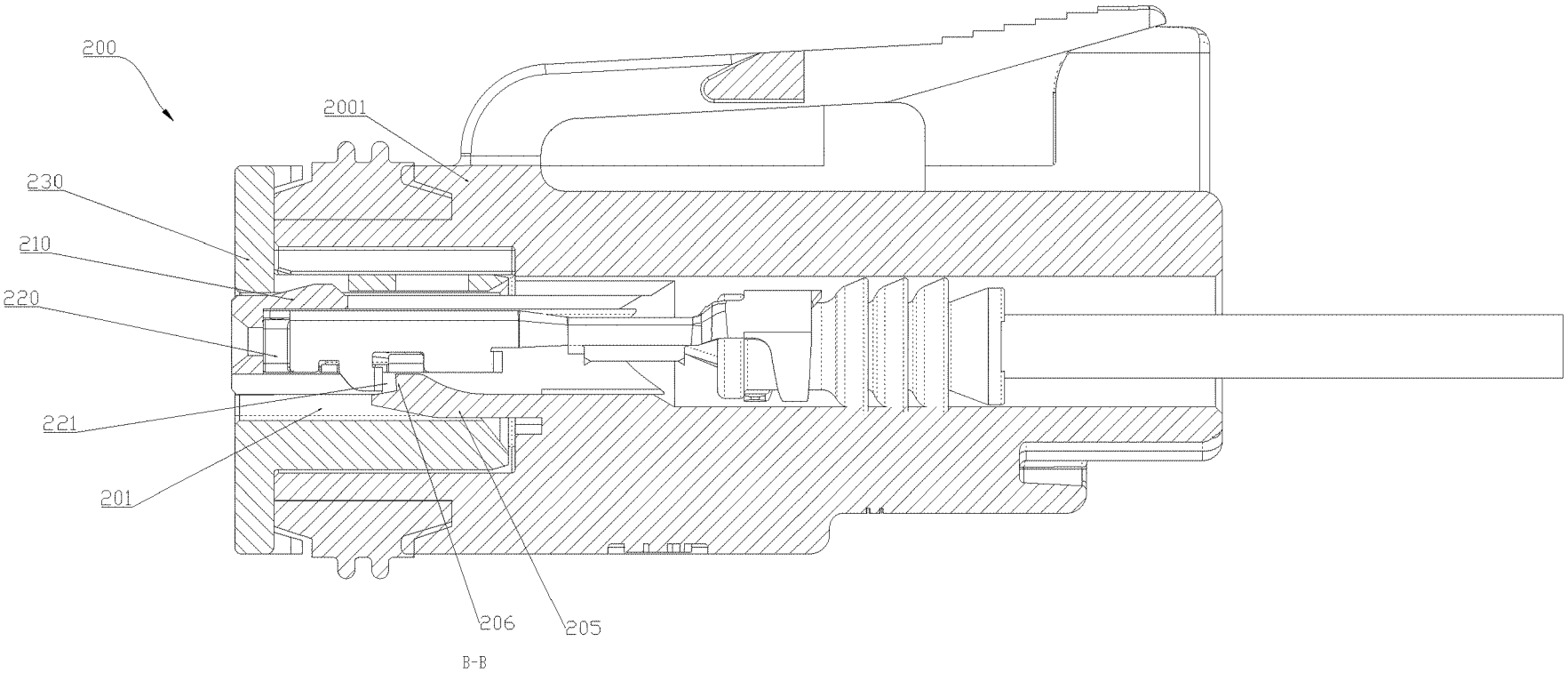
FIG. 10 is a sectional view taken along B-B of FIG. 9.
Figure 11:
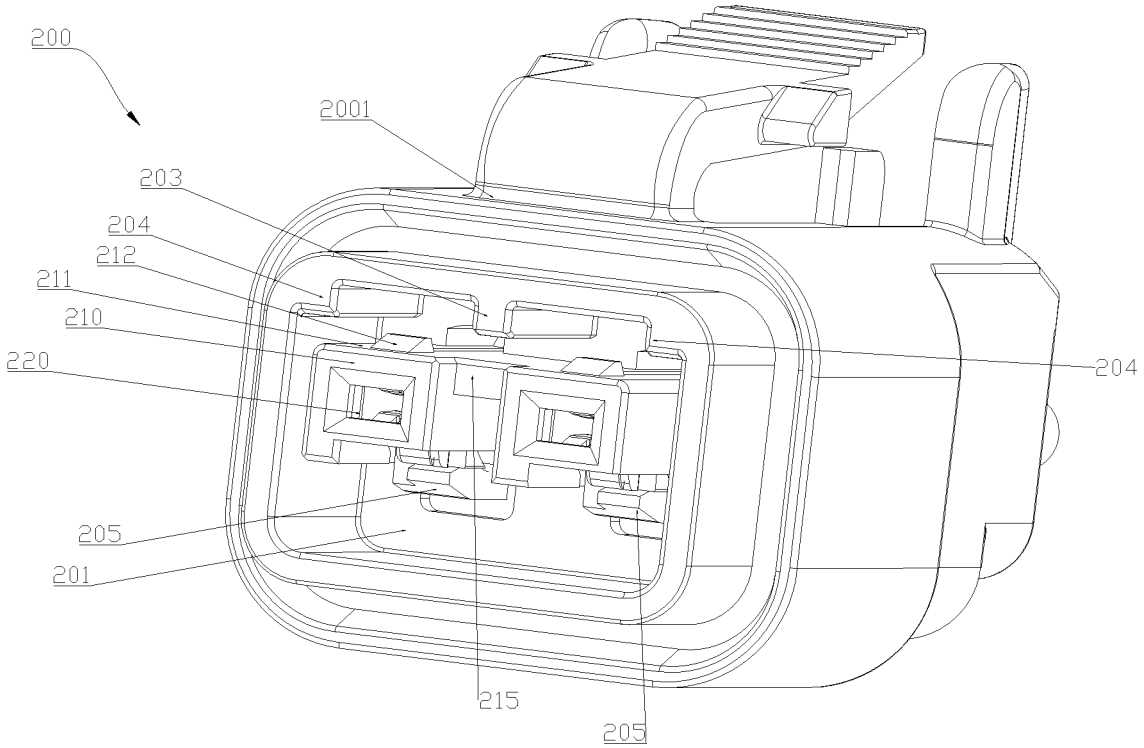
FIG. 11 is a structural schematic view of the second connector housing in Embodiment 2.
Figure 12:
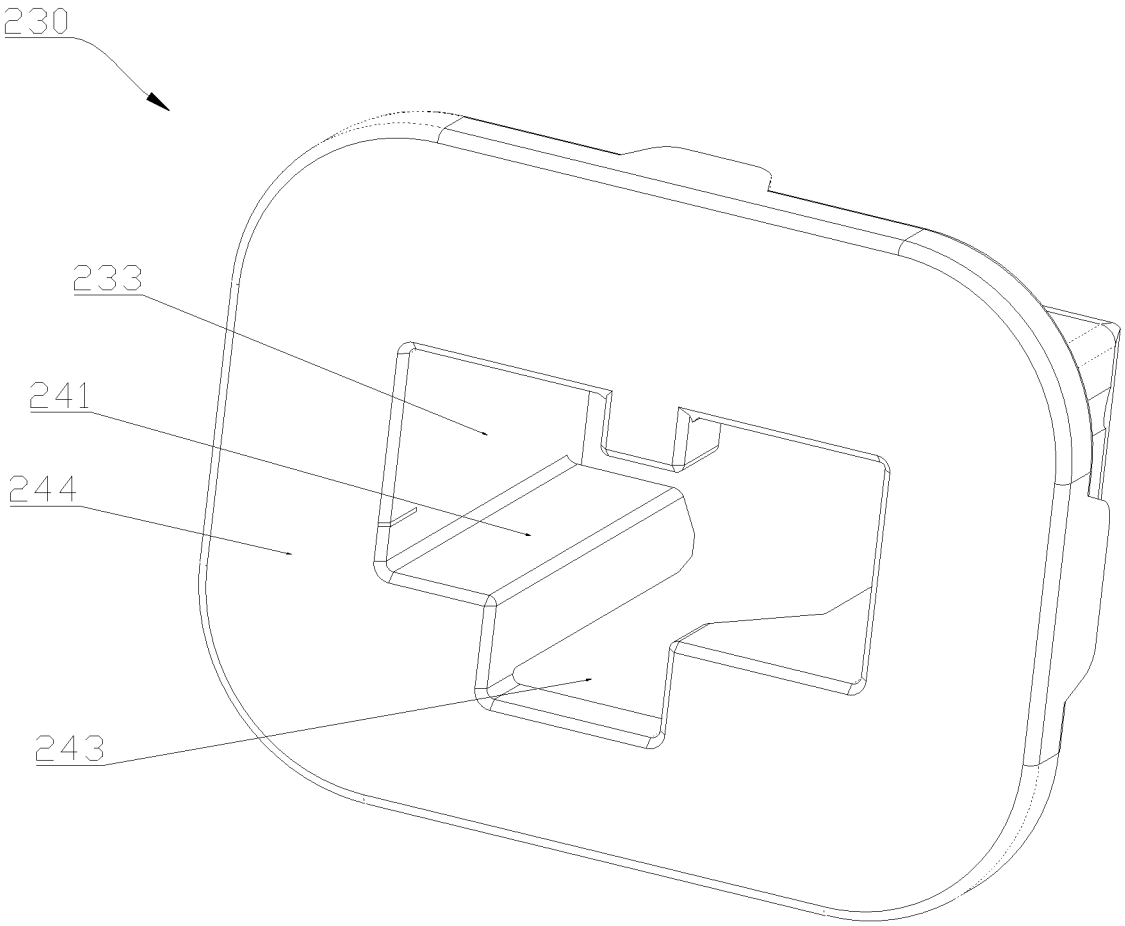
FIG. 12 is a structural schematic view of the second retainer in Embodiment 2.
Figure 13:
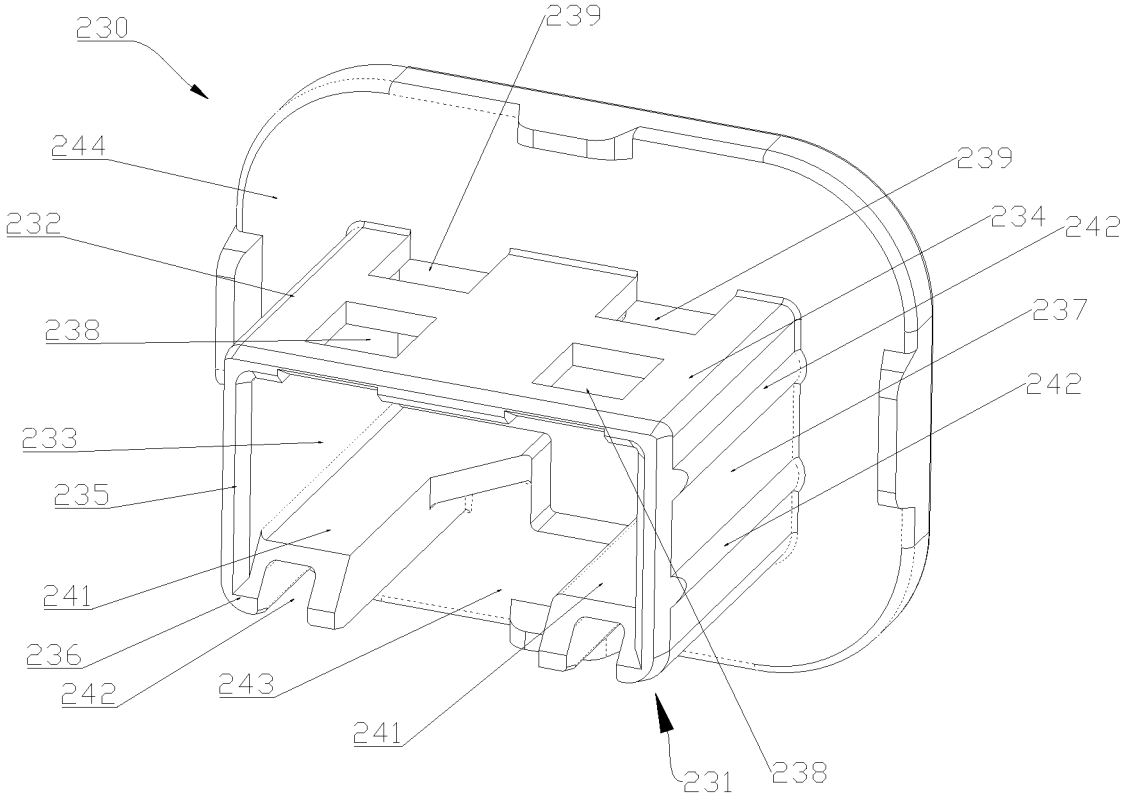
FIG. 13 is a structural schematic view of the second retainer viewed from another angle.

As shown in FIG. 7, the male terminal 120 is mounted on the male terminal mounting tube 110, and the end of the male terminal protrudes from the male terminal mounting tube 110 and is disposed to be suspended in the first receiving cavity 101. The male terminal 120 is provided with a first flange 121. The male terminal 120 is a stamped part. The other end 106 of the first elastic arm 105 abuts against the first flange 121 to prevent the male terminal 120 from exiting.

As shown in FIGS. 2 to 6, the first terminal retainer 130 is one of the examples of a terminal retainer, and includes a tubular retaining portion 131 including a tube wall 132 and a tube cavity 133 enclosed by the tube wall 132; the tubular retaining portion 131 extends axially a specified length determinable according to use requirements.

The first terminal retainer 130 is provided with a locking structure, wherein the locking structure comprises an initial locking structure and a final locking structure arranged on the tube wall 132, the initial locking structure and the final locking structure are respectively mated with a mating structure to lock the terminal retainer 130 in the initial locking position and the final locking position, respectively; when the tubular retaining portion 131 is moved relative to the mating structure, the initial locking structure and the final locking structure are located on a moving route of the mating structure. According to an embodiment of the present application, the mating structure is the afore-mentioned first bump 112. The initial locking structure and the final locking structure are arranged to be spaced apart along the axial direction of the tubular retaining portion 131, so that the initial locking structure and the final locking structure pass through the first bump 112 and are mated with the first bump 112, respectively, during insertion of the tubular retaining portion 131 into the receiving cavity 101. The first bump 112 is one of the embodiments of the bump. The first bump 112 is disposed toward the convex ridge 103.

In the illustrated example, the tube wall 132 is square-shaped, and the tube cavity 133 is enclosed by sequentially connecting an upper tube wall 134, a left tube wall 135, a lower tube wall 136, and a right tube wall 137. The initial locking structure and the final locking structure are located on the same surface of the tube wall 132. In the illustrated example, the initial locking structure and the final locking structure are located on the outer surface of the upper tube wall 134. The initial locking structure is a first through-hole, a first counterbore or a first groove. The final locking structure is a second through-hole, a second counterbore or a second groove. In the illustrated example, the initial locking structure is shown as a first through-hole 138 and the final locking structure is a second through-hole 139. The first through-hole 138 and the second through-hole 139 are both arranged on the lower tube wall 136 and run through the lower tube wall 136. During insertion of the tubular retaining portion 132 into the receiving cavity 101, the first through-hole 138 is first moved to the first bump 112, so that the first bump 112 is inserted into the first through hole 138 to limit the tubular retaining portion 132 to the initial locking position. In the initial locking position, the first terminal retainer 130 continues to be pushed inward, causing the tubular retaining portion 132 to move forward until the first bump 112 is released from the first through-hole 138, and the second through-hole 139 moves to the first bump 112, when the first bump 112 is embedded into the second through hole 139, the first terminal retainer 132 is restrained in the final locking position. Each of the first through hole and the second through hole is one of the embodiments of the through-hole. Each of the first counterbore and the second counterbore is one of the embodiments of the counterbore. Each of the first groove and the second groove is one of the embodiments of the groove.

An abutting structure is provided on the upper tube wall 134 radially opposite to the lower tube wall 136. The locking structure and the abutting structure are respectively arranged on the two tube walls radially opposite to each other, namely one of the locking structure and the abutting structure being arranged on the upper tube wall 134, the other being arranged on the lower tube wall 136. When the first terminal retainer 130 is located in the final locking position, the abutting structure is configured to abut against the first elastic arm 105, so that the first elastic arm 105 is retained in a position abutting against the male terminal 120 to prevent the male terminal 120 from exiting. According to the application, the other end 106 of the first elastic arm 105 may extend into the male terminal mounting tube 110 from the first perforation 114 to abut against the first flange 121; alternatively, the first flange 121 may protrude from the male terminal mounting tube 110 from the first perforation 114 to be abutted upon by the other end 106 of the first elastic arm 105. In addition, according to the embodiments of the application, after the male terminal 120 is mounted in the male terminal mounting tube 110, the other end 106 of the first elastic arm 105 may be abutted upon by the abutting structure so as to be in a position abuttable against the first flange 121 and to be retained in the position; alternatively, after the male terminal 120 is mounted in the male terminal mounting tube 110, the first flange 121 may protrude from the male terminal mounting tube 110 from the first perforation 114, and the first elastic arm 105 may be disposed in such a position that the other end 106 thereof is allowed to be in a position to abut against the first flange 121 and the first elastic arm 105 may be retained in the position by the abutting structure. In the illustrated example, after the male terminal 120 is mounted in the male terminal mounting tube 110, the first flange 121 protrudes from the male terminal mounting tube 110 from the first perforation 114, and the first elastic arm 105 is disposed in such a position that the other end 106 thereof is allowed to be in a position to abut against the first flange 121, and in the position the first elastic arm 105 is snap-fitted with the male terminal 120 and retained in the snap-fit position by the abutting structure.

In the illustrated example, the abutting structure is a U-shaped groove 141, an opening 142 of which is disposed to face away from the tube cavity 133. The U-shaped groove 141 is provided to extend from the inner surface of the tube wall 132 and project into the tube cavity 133 so that the U-shaped groove 141 can abut against the first elastic arm 105. There are two of the U-shaped grooves 141 which are arranged to be spaced apart.

The outer surfaces of the left tube wall 135 and the right tube wall 137 are further provided with two convex ribs 142 distributed at intervals, respectively; the convex ribs 142 protrude from the outer surfaces of the left tube wall 135 and the right tube wall 137. The first terminal retainer 130 is provided with a mating bar 143 having a shape mated with that of a mating groove described later, and the mating bar 143 is arranged to be pluggably inserted into the mating groove. In the illustrated example, the mating bar 143 is L-shaped in cross-section.

Embodiment 2

As shown in FIGS. 8 to 14, a mating connector 200 includes a second connector housing 2001 and a female terminal 220. The second connector housing 2001 is configured for mounting the female terminal 220. An end of the second connector housing 2001 is provided with a second receiving cavity 201 and the second receiving cavity 201 extends axially to a certain depth. The second receiving cavity 201 is one of the embodiments of the receiving cavity. In the illustrated example, the second receiving cavity 201 is square in cross-section. The second receiving cavity 201 is one of the embodiments of the receiving cavity. An inner surface 202 of the second receiving cavity 201 is provided with a convex ridge 203. The convex ridge 203 protrudes from the inner surface 202 of the second receiving cavity 201. The convex ridge 203 is provided in the middle of the left-right direction as shown. Two baffles 204 are disposed within the second receiving cavity 201. The two baffles 204 are provided on either side of the convex ridge 203, respectively. The two baffles 204 are configured to guide a second terminal retainer 230 described later during plug-in connection. A second elastic arm 205 is disposed within the second receiving cavity 201. An end of the second elastic arm 205 is connected to the second connector housing 2001 and the other end 206 is disposed to be suspended. The second elastic arm 205 is resiliently arranged, and the other end 206 thereof is arranged to be movable under pressure.

A female terminal mounting tube 210 is provided in the second receiving cavity 201. The female terminal mounting tube 210 is one of the embodiments of the terminal mounting tube. An end of the female terminal mounting tube 210 is connected to the interior of the second connector housing 2001 and is disposed to be suspended for a certain length. An upper surface 211 of each female terminal mounting tube 210 is provided with a second bump 212. The second bump 212 protrudes from the upper surface 211. The female terminal mounting tube 210 is provided with a second perforation (not shown). The two female terminal mounting tubes 210 are connected by a connecting plate 215. A second elastic arm 205 is disposed below the second perforation 214. The second elastic arm 205 is an embodiment of a snap-fit mechanism and the elastic arm described in the present application.

Figure 14:
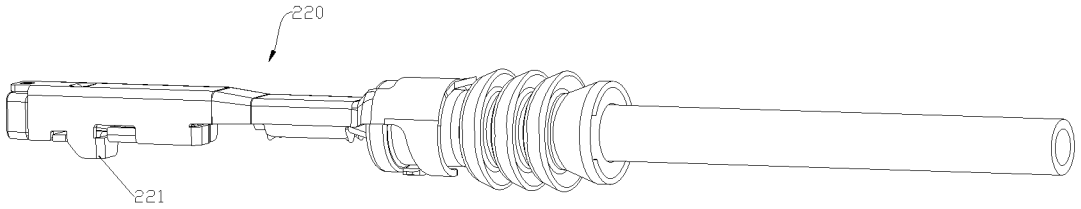
FIG. 14 is a structural schematic view of the male terminal in Embodiment 2.

The female terminal 220 is mounted on the female terminal mounting tube 210, and an end of the female terminal protrudes from the female terminal mounting tube 210 and disposed to be suspended in the second receiving cavity 201. As shown in FIG. 14, the female terminal 220 is provided with a second flange 221. The female terminal 220 is a stamped part. The other end 206 of the second elastic arm 205 abuts against the second flange 221 to prevent the female terminal 220 from exiting. The female terminal 220 is square-shaped in outline.

As shown in FIGS. 10 to 13, the second terminal retainer 230 is one of the embodiments of the terminal retainer, and includes a tubular retaining portion 231 including a tube wall 232 and a tube cavity 233 enclosed by the tube wall 232; the tubular retaining portion 231 extends axially a specified length determinable according to use requirements.

The tube wall 232 is provided with an initial locking structure and a final locking structure, wherein the initial locking structure and the final locking structure are mated with a mating structure respectively to lock the terminal retainer 230 in the initial locking position and the final locking position respectively; and when the tubular retaining portion 231 is moved with respect to the mating structure, the initial locking structure and the final locking structure are located on a moving route of the mating structure. According to an embodiment of the present application, the mating structure is the afore-mentioned second bump 212.

The initial locking structure and the final locking structure are arranged to be spaced apart along the axial direction of the tubular retaining portion 231, so that the initial locking structure and the final locking structure respectively pass through the second bump 212 and are mated with the second bump 212 during insertion of the tubular retaining portion 231 into the receiving cavity 201. The second bump 212 is one of the embodiments of the bump. The second bump 212 is disposed toward the convex ridge 203.

In the illustrated example, the tube wall 232 is square-shaped, and the tube cavity 233 is enclosed by sequentially connecting an upper tube wall 234, a left tube wall 235, a lower tube wall 236, and a right tube wall 237. The initial locking structure and the final locking structure are located on the same surface of the tube wall. The initial locking structure is a third through-hole, a third counterbore or a third groove. The final locking structure is a fourth through-hole, a fourth counterbore or a fourth groove. In the illustrated example, the initial locking structure is shown as a third through-hole 238 and the final locking structure is a fourth through-hole 239. The third through-hole 238 and the fourth through-hole 239 are both disposed on the lower tube wall 236 and run through the lower tube wall 236. During insertion of the tubular retaining portion 232 into the receiving cavity 201, the third through-hole 238 is first moved to the second bump 212, so that the second bump 212 is embedded into the third through-hole 238 to restrain the tubular retaining portion 232 in the initial locking position. In the initial locking position, the second terminal retainer 230 continues to be pushed inward to move the tubular retaining portion 232 forward until the second bump 212 is released from the third through-hole 238 and the fourth through-hole 239 is moved to the second bump 212, when the second bump 212 is embedded into the fourth through-hole 239, the second terminal retainer 232 is restrained in the final locking position. Each of the third through-hole and the fourth through-hole is one of the embodiments of the through-hole. Each of the third counterbore and the fourth counter bore is one of the embodiments of the counterbore. Each of the third groove and the fourth groove is one of the embodiments of the groove.

An abutting structure is provided on the upper tube wall 234 opposite to the lower tube wall 236. When the second terminal retainer 230 is located in the final locking position, the abutting structure is configured to abut against the second elastic arm 205, so that the second elastic arm 205 is retained in a position abutting against the female terminal 220 to prevent the female terminal 220 from exiting. According to the application, the other end 206 of the second elastic arm 205 may extend into the female terminal mounting tube 210 from the second perforation 214 to abut against the second flange 221; alternatively, the second flange 221 may protrude from the female terminal mounting tube 210 from the second perforation 214 to be abutted against by the other end 206 of the second elastic arm 205. In addition, according to the embodiments of the application, after the female terminal 220 is mounted in the female terminal mounting tube 210, the other end 206 of the second elastic arm 205 may be abutted against by the abutting structure so as to be in a position abuttable against the second flange 221 and to be retained in the position; alternatively, after the female terminal 220 is mounted in the female terminal mounting tube 210, the second flange 221 may protrude from the female terminal mounting tube 210 from the second perforation 214, and the second elastic arm 205 may be disposed in such a position that the other end 206 thereof is allowed to be in a position to abut against the second flange 221, and the second elastic arm 205 may be retained in the position by the abutting structure. In the illustrated example, after the female terminal 220 is mounted in the female terminal mounting tube 210, the second flange 221 protrudes from the female terminal mounting tube 210 from the second perforation 214, and the second elastic arm 205 is disposed in such a position that the other end 206 thereof is allowed to be in a position to abut against the second flange 221, and the second elastic arm 205 is retained in the position by the abutting structure.

In the illustrated example, the abutting structure is a U-shaped groove 241, an opening 242 of which is disposed to face away from the tube cavity 233. The U-shaped groove 241 is provided to extend from the inner surface of the tube wall 232 and project into the tube cavity 133 so that the U-shaped groove 241 can abut against the second elastic arm 205. There are two of the U-shaped grooves 241 which are arranged to be spaced apart.

The outer surfaces of the left tube wall 235 and the right tube wall 237 are further provided with two convex ribs 242 distributed at intervals, respectively; the convex ribs 242 protrude from the outer surfaces of the left tube wall 235 and the right tube wall 237. The second terminal retainer 230 is provided with a mating groove 243 having a shape mated with that of the mating bar 143 in Embodiment 1, and the mating bar 143 is arranged to be pluggably inserted into the mating groove 243. An end of the tubular retaining portion 231 is provided with a flange plate 244. The flange plate 244 is provided to project radially from the tubular retaining portion 231.

Embodiment 3

Figure 15:
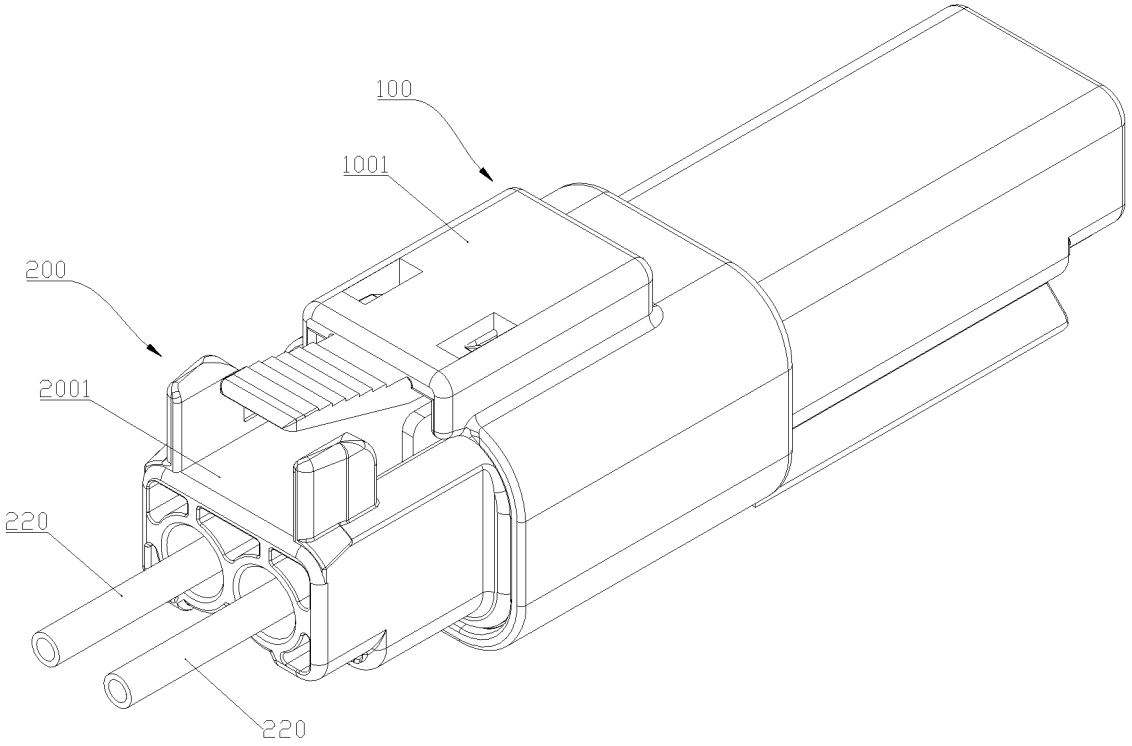
FIG. 15 is a structural schematic view of Embodiment 3.

As shown in FIG. 15, a connector assembly includes the connector 100 in Embodiment 1 and the mating connector 200 in Embodiment 2. The connector 100 includes the first connector housing 1001 and the male terminal 120. The first connector housing 1001 is configured for mounting the male terminal 120. The mating connector 200 includes the second connector housing 2001 and the female terminal 220. The second connector housing 2001 is configured for mounting the female terminal 220. The first connector housing 1001 is pluggably plugged into the second connector housing 2001, and the male terminal 120 is pluggably plugged into the female terminal 220. The mating bar 143 of the first terminal retainer 130 is inserted into the mating groove 243.

The embodiments in the present application are merely intended for explaining the present application, and do not constitute any limitation on the scope of the claims, and other substantially equivalent substitutions which may occur to a person skilled in the art are all to be covered within the scope of the present application.

The invention claimed is:

1. A terminal retainer comprising a tubular retaining portion, wherein the tubular retaining portion comprises a tube wall and a tube cavity enclosed by the tube wall, and extends a length in an axial direction;

the tube wall is provided with a locking structure comprising an initial locking structure and a final locking structure which are mated with a mating structure respectively to lock the terminal retainer in an initial locking position and a final locking position respectively; and an abutting structure which is configured to abut against a snap-fit mechanism located in the tube cavity when the terminal retainer is in the final locking position, so that the snap-fit mechanism is retained in a snap-fit position;

wherein the tubular retaining portion is formed with a mating structure extending axially for pluggably engaging with a corresponding mating structure on a mating terminal retainer.

2. The terminal retainer of claim 1, wherein the locking structure and the abutting structure are disposed on two sections of the tube wall radially opposite to each other, respectively.

3. The terminal retainer of claim 1, wherein the abutting structure is disposed to extend from an inner surface of the tube wall and project into the tube cavity and, wherein the abutting structure is a U-shaped groove, an opening of which is disposed to face away from the tube cavity.

4. The terminal retainer of claim 1, wherein an outer surface of the tube wall is provided with a convex rib; and the convex rib is configured to protrude from the outer surface of the tube wall.

5. The terminal retainer of claim 4, wherein the convex rib and the locking structure are respectively provided on different surfaces of the tube wall.

6. The terminal retainer of claim 1, wherein the terminal retainer is also provided with a flange plate perpendicular to the axial direction protruding from the tube wall.

7. The terminal retainer of claim 1, wherein the terminal retainer is also provided with a mating bar projecting axially from the tube wall.

8. A connector comprising a connector housing and a terminal retainer, wherein the terminal retainer comprises a tubular retaining portion extending in an axial direction, the tubular retaining portion comprising a tube wall and a tube cavity enclosed by the tube wall;

wherein the tube wall is provided with a locking structure comprising an initial locking structure and a final locking structure which are mated with a mating structure respectively to lock the terminal retainer in an initial locking position and a final locking position respectively; and wherein an abutting structure is configured to abut against a snap-fit mechanism located in the tube cavity when the terminal retainer is in the final locking position, so that the snap-fit mechanism is retained in a snap-fit position;

wherein an end of the connector housing is provided with a terminal mounting tube and an elastic arm, and wherein a bump is provided on an outer surface of the terminal mounting tube and located inside a receiving chamber of the connector housing for mating with the locking structure on the terminal retainer to hold the terminal retainer on the housing.

9. The connector of claim 8, wherein the connector housing is provided with a receiving cavity in which a terminal mounting tube and an elastic arm are provided, the terminal mounting tube being provided with a perforation; a connection terminal is provided with a flange, and an end of the connection terminal is inserted into the terminal mounting tube; the terminal retainer is inserted into the receiving cavity and abuts against the elastic arm, so that the elastic arm is held in a state of abutting the flange to allow the elastic arm to prevent the connection terminal from exiting.

10. The connector of claim 9, wherein the terminal retainer has an initial locking position and a final locking position within the receiving cavity; in the final locking position, the terminal retainer is inserted into the receiving cavity to abut against the elastic arm, so that the elastic arm is kept in a state of abutting against the flange through the perforation, or the flange protrudes from the perforation, and the terminal retainer abuts against the elastic arm to keep the elastic arm in a state of abutting against the flange.

11. The connector of claim 8, wherein an end of the housing is provided with a receiving cavity configured for receiving the terminal retainer; the terminal mounting tube and the elastic arm are arranged in the receiving cavity.

12. The connector of claim 11, wherein an inner surface of the housing is protrudingly provided with a convex ridge configured to be contactable with an outer surface of the terminal retainer.

13. A connector assembly comprising a connector and a mating connector, wherein the connector comprises a first connector housing and a first terminal retainer disposed on the first connector housing; the mating connector comprises a second connector housing and a second terminal retainer disposed on the second connector housing; the connector is pluggably in plug-in connection with the mating connector; wherein a tubular retaining portion of one of the terminal retainers is provided with a mating groove extending axially; the other terminal retainer is provided with a mating bar, and the mating bar has a shape mated with that of the mating groove and is configured to be pluggably inserted into the mating groove; and after the first connector housing is plugged into the second connector housing, the mating bar is arranged to be inserted in the mating groove.

14. The connector assembly of claim 13, wherein the first connector housing is provided with a first receiving cavity within which a male terminal mounting tube and a first elastic arm are provided, the male terminal mounting tube is provided with a first perforation and a male terminal is inserted into the male terminal mounting tube; the first terminal retainer is inserted into the first receiving cavity so as to be abuttable against the first elastic arm, so that the first elastic arm is kept in a state of abutting against the male terminal to prevent the male terminal from exiting; the second connector housing is provided with a second receiving cavity within which a female terminal mounting tube and a second elastic arm are provided, and the female terminal mounting tube is provided with a second perforation; and a female terminal is inserted into the female terminal mounting tube; and the second terminal retainer is inserted into the second receiving cavity so as to be abuttable against the second elastic arm, so that the second elastic arm is kept in a state of abutting against the female terminal to prevent the female terminal from exiting.

15. The connector assembly of claim 14, wherein an outer surface of the male terminal mounting tube is provided with a first bump, an initial locking structure of the first terminal retainer is a first through-hole, a first counterbore or a first groove, and a final locking structure of the first terminal retainer is a second through-hole, a second counterbore or a second groove; the first bump is arranged on a moving route of the initial locking structure and the final locking structure of the first terminal retainer; when the first bump is embedded into the first through-hole, the first counterbore or the first groove, the first terminal retainer is kept in an initial locking position; and when the second bump is embedded into the second through-hole, the second counterbore or the second groove, the first terminal retainer is kept in a final locking position.

16. The connector assembly of claim 14, wherein an outer surface of the female terminal mounting tube is provided with a second bump, an initial locking structure of the second terminal retainer is a third through-hole, a third counterbore or a third groove, and a final locking structure of the second terminal retainer is a fourth through-hole, a fourth counterbore or a fourth groove; the second bump is arranged on a moving route of the initial locking structure and the final locking structure of the second terminal retainer; when the second bump is embedded into the third through-hole, the third counterbore or the third groove, the second terminal retainer is kept in an initial locking position; and when the second bump is embedded in the fourth through-hole, the fourth counterbore or the fourth groove, the second terminal retainer is kept in a final locking position.

17. The connector assembly of claim 14, wherein the male terminal is provided with a first flange, and the first elastic arm is arranged to abut against the first flange to prevent the male terminal from exiting; and/or the female terminal is provided with a second flange, and the second elastic arm is arranged to abut against the second flange to prevent the female terminal from exiting.

18. The connector assembly of claim 13, wherein an outer surface of the first terminal retainer is in multiple line contact with an inner surface of the first connector housing; and/or an outer surface of the second terminal retainer is in multiple line contacts with an inner surface of the second connector housing.

19. The connector assembly of claim 13, wherein an outer surface of the tubular retaining portion is provided with a convex rib; when the first terminal retainer is inserted into the first connector housing, the convex rib is in contact with an inner surface of the first connector housing, and/or when the second terminal retainer is inserted into the second connector housing, the convex rib is in contact with an inner surface of the second connector housing.

20. The connector assembly of claim 13, wherein an inner surface of the first connector housing or the second connector housing is provided with a convex ridge; and the convex ridge is in contact with an outer surface of the tubular retaining portion; and wherein the convex ridge is disposed on an inner surface opposite to the initial and final locking structures.

* * * * *